US011493055B2

(12) United States Patent
Morselli

(10) Patent No.: US 11,493,055 B2
(45) Date of Patent: Nov. 8, 2022

(54) RADIAL PUMP

(71) Applicant: STEM NUMERICAL ENGINEERING S.R.L., Modena (IT)

(72) Inventor: Mario Antonio Morselli, Modena (IT)

(73) Assignee: STEM NUMERICAL ENGINEERING S.R.L., Modena (IT)

( * ) Notice: Subject to any disclaimer, the term of this patent is extended or adjusted under 35 U.S.C. 154(b) by 0 days.

(21) Appl. No.: 17/271,812

(22) PCT Filed: Sep. 6, 2019

(86) PCT No.: PCT/IB2019/057519
§ 371 (c)(1),
(2) Date: Feb. 26, 2021

(87) PCT Pub. No.: WO2020/049511
PCT Pub. Date: Mar. 12, 2020

(65) Prior Publication Data

US 2021/0324871 A1 Oct. 21, 2021

(30) Foreign Application Priority Data

Sep. 6, 2018 (IT) ..... 102018000008397

(51) Int. Cl.
*F04D 29/24* (2006.01)
*F04D 29/02* (2006.01)
*F04D 1/00* (2006.01)

(52) U.S. Cl.
CPC ..... *F04D 29/247* (2013.01); *F04D 29/02* (2013.01); *F04D 29/242* (2013.01); *F04D 1/00* (2013.01)

(58) Field of Classification Search
CPC ..... F04D 29/02; F04D 29/242; F04D 29/247
See application file for complete search history.

(56) References Cited

U.S. PATENT DOCUMENTS 2,684,035 A 7/1954 Kemp
3,832,105 A * 8/1974 Takahashi ..... F04C 5/00 418/253

(Continued)

FOREIGN PATENT DOCUMENTS

EP 1310678 A1 5/2003
EP 1365157 A1 11/2003
JP S59-99084 A 6/1984

OTHER PUBLICATIONS

International Search Report and Written Opinion dated Dec. 19, 2019 in PCT/IB2019/057519, 12 pages.

*Primary Examiner* — Richard A Edgar
*Assistant Examiner* — Jason G Davis
(74) *Attorney, Agent, or Firm* — Element IP, PLC

(57) ABSTRACT

Radial pump (1) comprising a stator (3) comprising an external stator (30) and an internal stator (32) defining an annular cavity (11) therebetween, and an impeller (5) rotatably housed between said stators (30; 32). The suction (7) is fashioned at a central portion of the internal stator (32), whereas the delivery (9) is fashioned at a radially external peripheral portion of the external stator (30). The impeller (5) comprises a plurality of deformable vanes (50, 51, 52) movable inside the annular cavity (11) and in slidable contact with the internal surface of the external stator (30). In every position of the impeller (5) with respect to the stator (3) at least two deformable vanes (51) are sealed in the portion of the annular cavity (11) between the suction (7) and the delivery (9) to isolate the delivery (9) from the suction (7). The impeller (5) is rotatable about a central internal axis (AI) offset with respect to the central external axis (AE) of the external stator (30), where the rotational eccentricity of the impeller (5) with respect to the external stator (30) determines a deformation of the deformable (Continued)

vanes (50, 51, 52) that contributes to the generation of flow rate of said pump (1).

16 Claims, 7 Drawing Sheets

(56) References Cited

U.S. PATENT DOCUMENTS

| | | | | |
|---|---|---|---|---|
| 4,008,985 | A | 2/1977 | Schemmann et al. | |
| 5,697,773 | A * | 12/1997 | Mendoza | F01C 1/44 415/141 |
| 6,264,450 | B1 | 7/2001 | Woodruff | |

* cited by examiner

RADIAL PUMP

The present invention relates to an improved radial pump able to provide hydrodynamic energy to a fluid by combining a centrifugal effect typical of centrifugal pumps with a volumetric effect typical of volumetric pumps.

A centrifugal pump uses the centrifugal effect of an impeller placed inside a stator for moving a liquid from a suction pipe, communicating with the centre of the pump, and in particular with the centre of the impeller (so-called axial suction), to a delivery pipe, communicating with the periphery of the pump, and in particular with the periphery of the stator (so-called radial delivery).

As it will be explained better below, also the improved radial pump according to the invention has such a configuration, i.e. an axial suction approximately at the centre of the impeller and a delivery at the periphery of the stator.

The impeller in such traditional centrifugal pumps is a wheel provided with curved rigid vanes, which form channels generally with an increasing section from the centre of the impeller towards the periphery, sometimes with a constant section.

Generally, centrifugal pumps have a good or however acceptable efficiency at a relatively narrow field of the rotation speed, which depends on the geometry of the vanes defined in the design. To extend the satisfactory field of use, there are variable geometric configurations, which are complex, expensive and subject to damage in the articulated movable parts and that must be appropriately adjusted.

The main task of the present invention is to provide an improved pump that overcomes the limits of centrifugal pumps of the known type allowing the efficiency and duration thereof to be improved, in particular in the case of small pumps for which the efficiency of centrifugal pumps is generally penalized.

Within the scope of this task, an object of the present invention is to provide an improved pump that can be operated in wide operating regimes, based on the needs of the users.

A further object of the invention is to provide an improved pump that is capable of providing the broadest guarantees of reliability and safety when used.

Another object of the invention is to provide an improved pump that is easy to make and is economically competitive when compared to the prior art.

The task disclosed above, as well as the objects mentioned and others which will become more apparent as follows, are achieved by an improved pump as described in claim 1.

Other characteristics are provided in the dependent claims.

Further features and advantages shall result more apparent from the description of a preferred, but not exclusive, embodiment of an improved pump, illustrated merely by way of non-limiting example with the aid of the accompanying drawings, in which.

Figure 4:
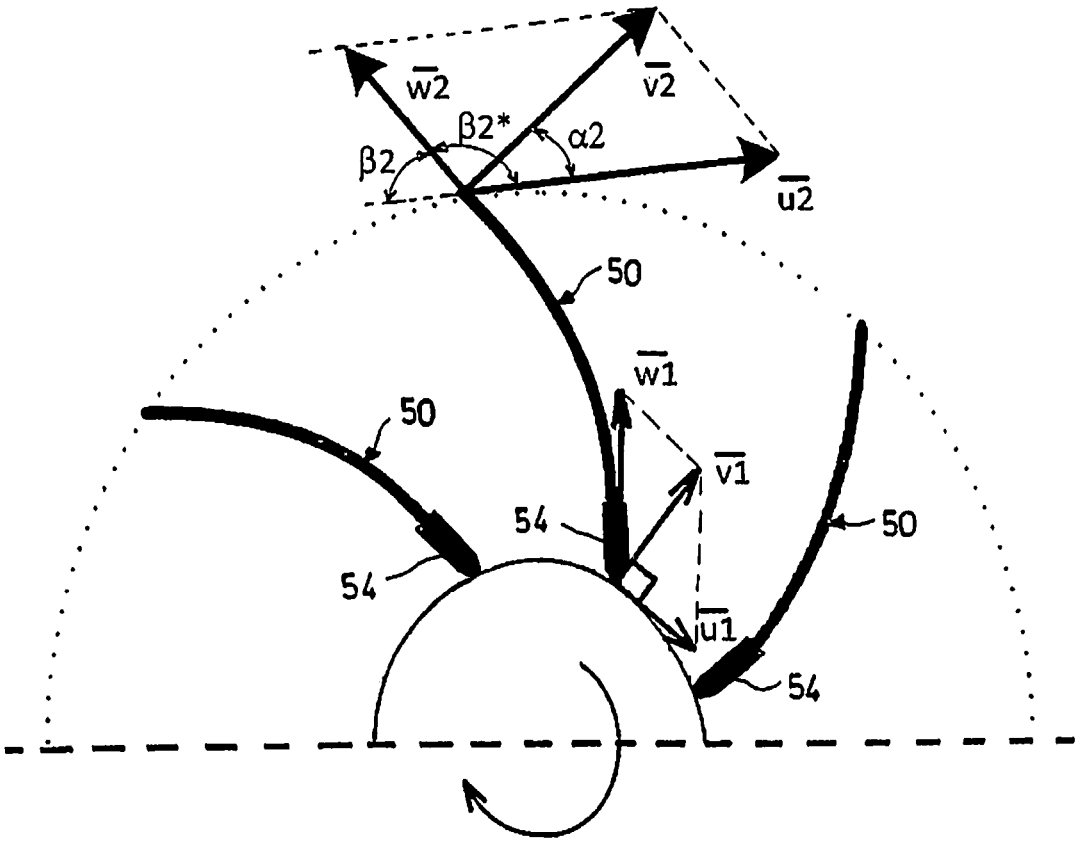
Figure 5:
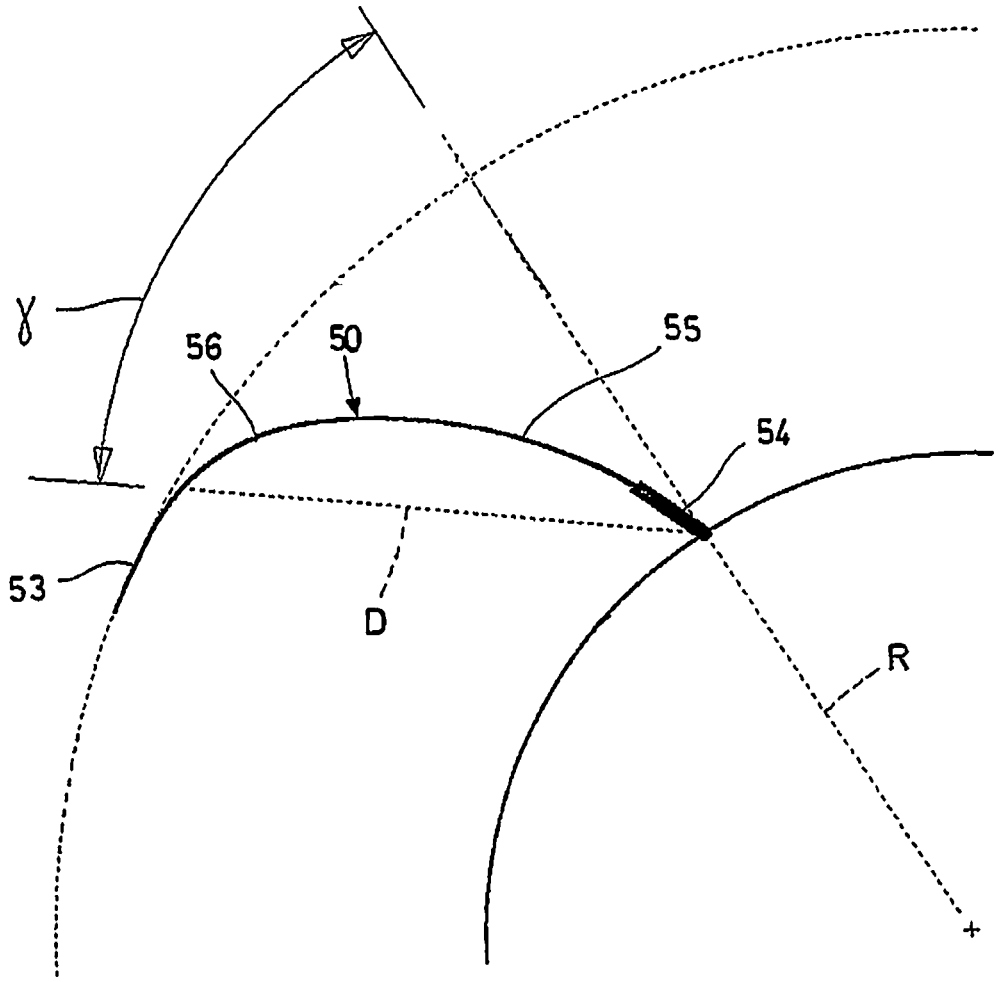
Figure 6:
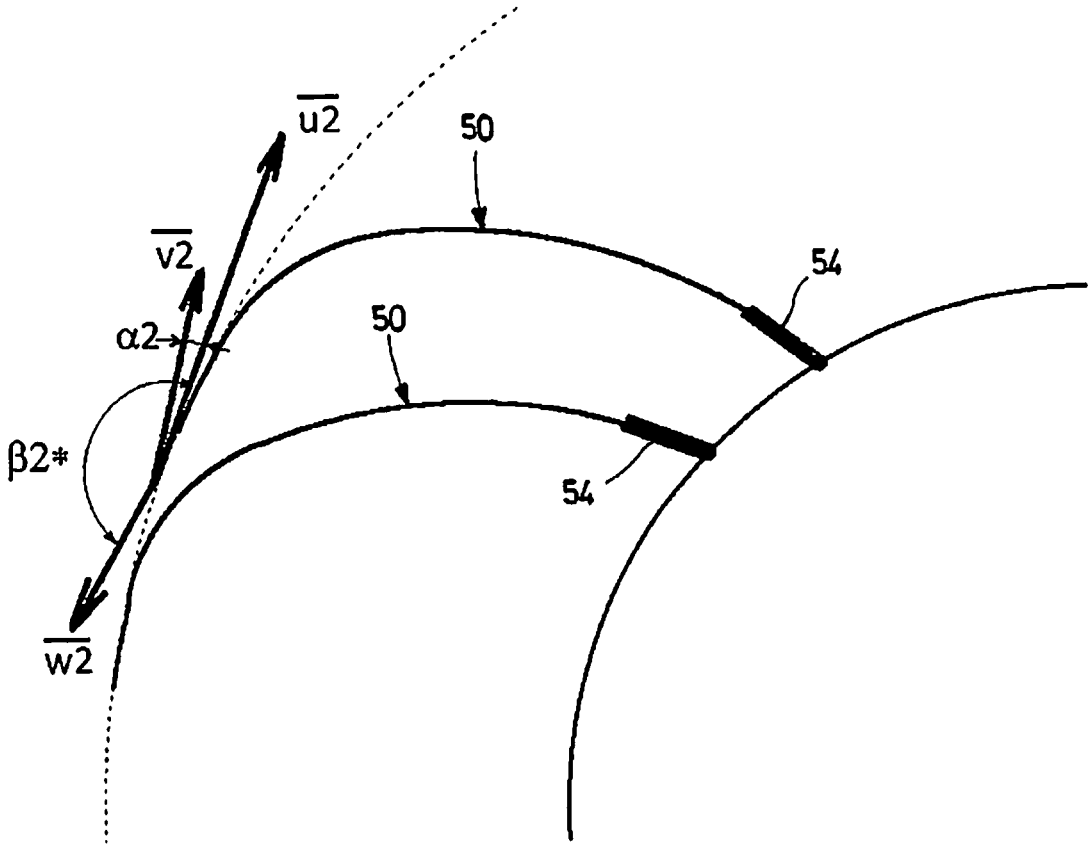
Figure 7:
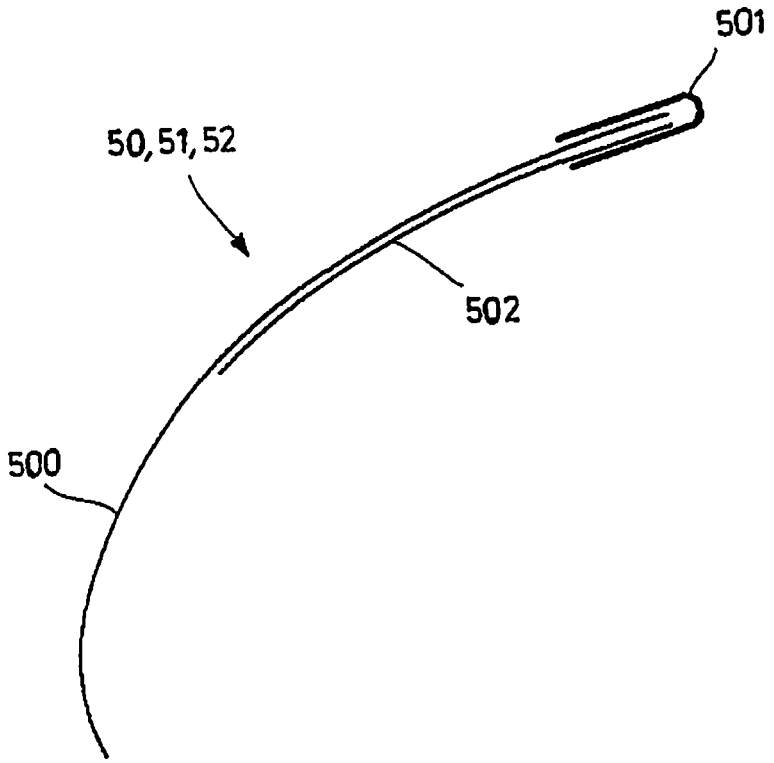
Figure 8:
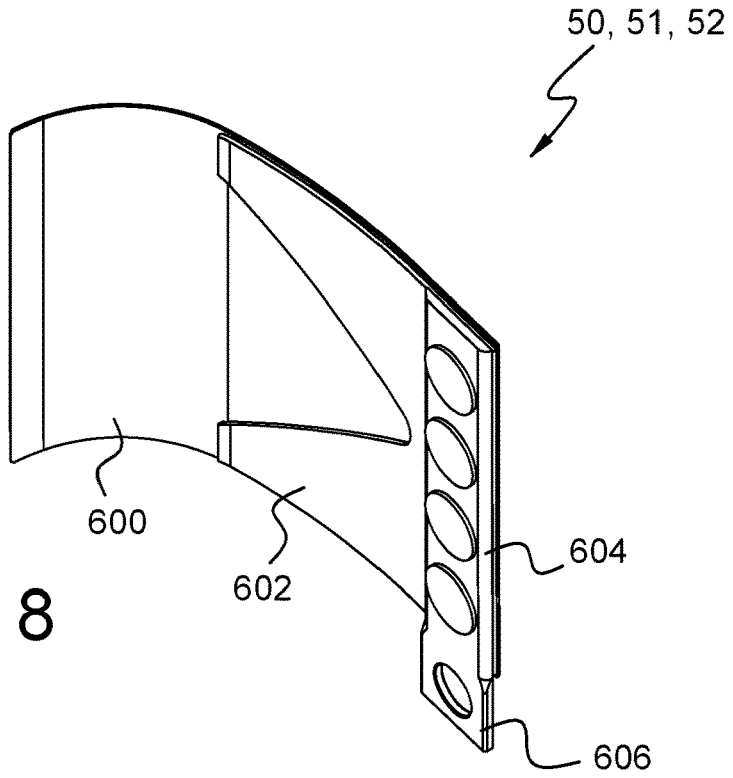
Figure 9:
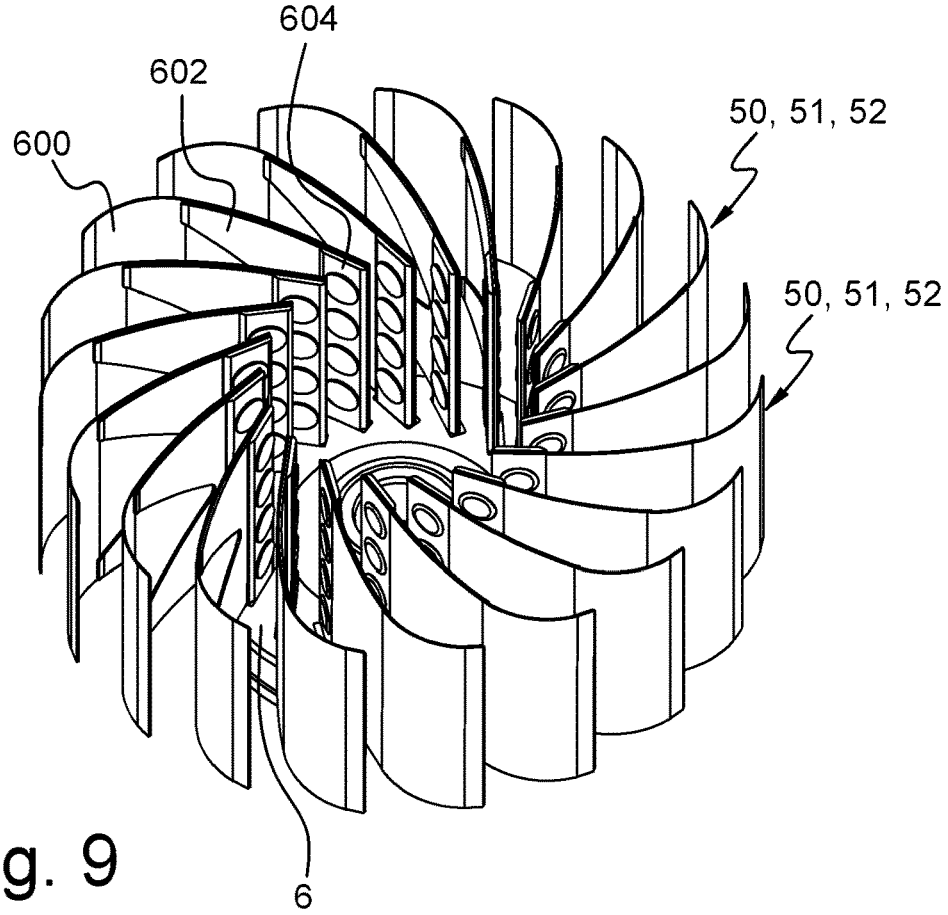

FIGS. 4 to 6 schematically illustrate a portion of the improved pump, according to the invention, showing some references related to geometric and velocity parameters of the individual deformable vane;

FIG. 7 illustrates a first embodiment example of a deformable vane of the improved pump, according to the invention;

FIG. 8 illustrates a second embodiment example of a deformable vane of the improved pump, according to the invention;

FIG. 9 illustrates the deformable vanes of FIG. 8 applied to an element of the impeller of the improved pump, according to the invention.

With reference to the mentioned figures, the improved pump, indicated overall by reference number 1, comprises, according to the invention, a stator 3 comprising an external stator 30 and an internal stator 32, and an impeller 5 rotatably housed between said external stator 30 and said internal stator 32.

The suction 7 is fashioned at a central portion of the internal stator 32, whereas the delivery 9 is fashioned at a radially external peripheral portion of the external stator 30.

The impeller 5 comprises a plurality of deformable vanes 50, 51, 52 movable inside an annular cavity 11 defined between the external stator 30 and the internal stator 32 and in slidable contact with the internal surface of the external stator 30.

In every position of the impeller 5 with respect to the stator 3 at least two deformable vanes 51 of the plurality of deformable vanes 50, 51, 52 are sealed in the portion 110 of the annular cavity 11 between the suction 7 and the delivery 9 to isolate the delivery 9 from the suction 7.

The impeller 5 is rotatable about a central internal axis AI offset with respect to the central external axis AE of the external stator 30, where the rotational eccentricity of the impeller 5 with respect to the external stator 30 determines a deformation of the deformable vanes 50, 51, 52. Such deformation of the deformable vanes 50, 51, 52 determines, at the delivery 9, a reduction in the volume of space comprised between two contiguous deformable vanes 50, 51, 52 (so-called "intervane channel"). Such reduction in the volume of space comprised between two deformable vanes 50, 51, 52 at the delivery 9 contributes to the generation of the flow rate of said improved pump 1.

The aforesaid reduction in volume, hereinafter also referred to as "squeezing", also contributes to the efficiency of the pump 1 as it prevents, or however attenuates, any vane detachment phenomena that cause losses of efficiency in centrifugal pumps of the known type.

Advantageously such eccentricity is equal to a value comprised in the range between $1/30$ and $1/15$ of the internal diameter of the external stator 30, preferably equal to a value comprised in the range between $1/25$ and $1/18$, and even more preferably comprised in the range between $1/22$ and $1/19$ of the internal diameter of the external stator 30.

In a preferred embodiment of the improved pump 1, the eccentricity is advantageously equal to a value comprised in the range between $1/40$ and $1/22$ of the internal diameter of the external stator 30, preferably equal to a value comprised in the range between $1/33$ and $1/29$, and even more preferably equal to about $1/31$ of the internal diameter of the external stator 30.

Figure 1:
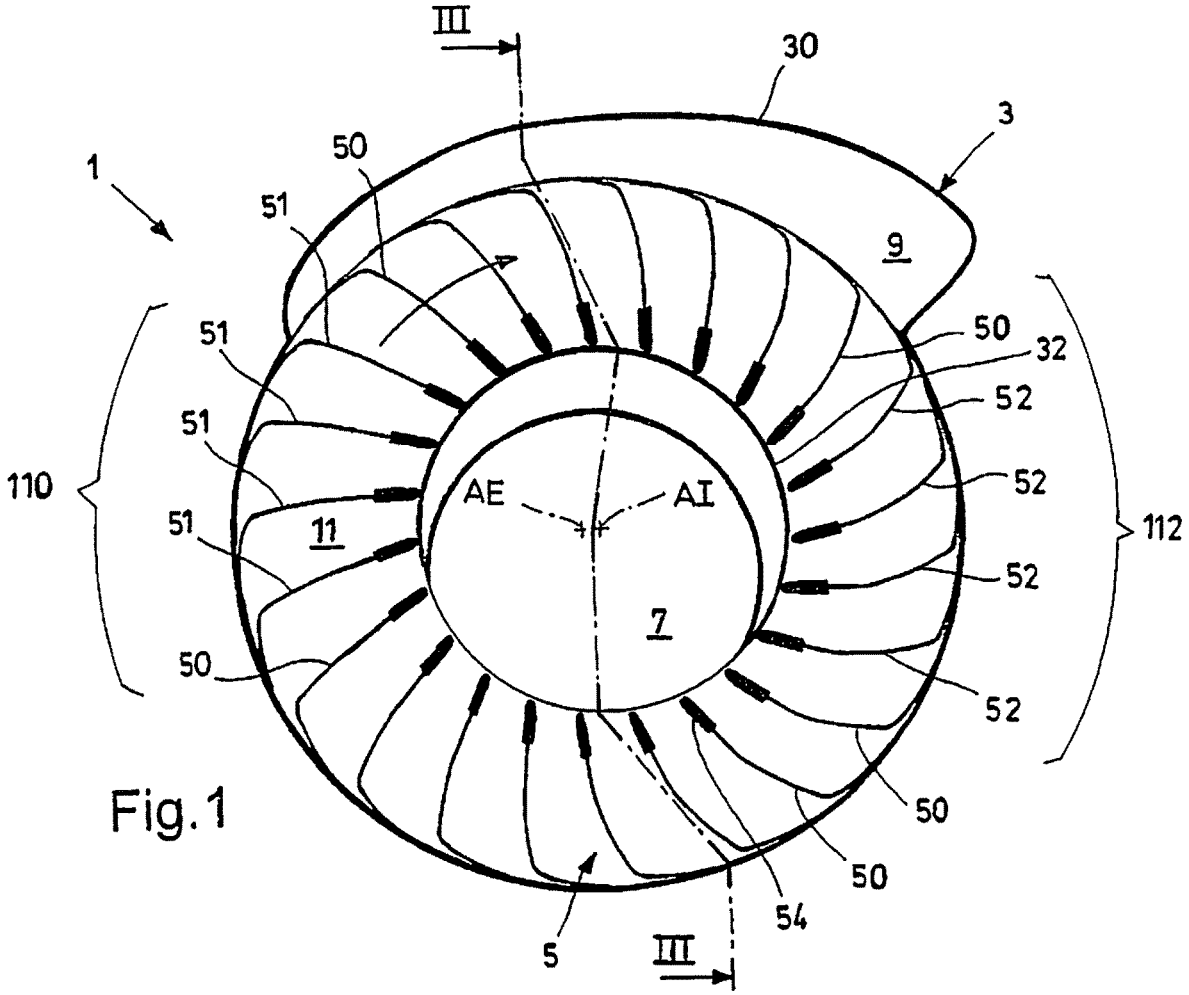
FIG. 1 is a front schematic view of an embodiment of an improved pump, according to the invention.
Figure 2:
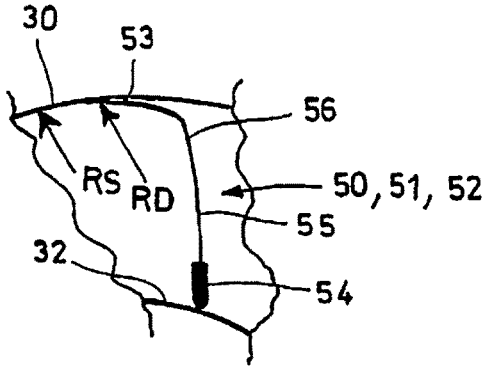
FIG. 2 illustrates a deformable vane of the pump of FIG. 1, according to the invention.

The eccentricity of the impeller 5 with respect to the stator 3, which can be attributed to the fact that the axes AI and AE are offset, as illustrated in FIG. 1, in fact implies a different deformation of the deformable vanes 50, 51, 52 in the various portions of the pump 1 between suction 7 and delivery 9, where such deformation modifies the volume of the conduits defined between two contiguous vanes for imparting to the pump 1 also an operation that in part resembles the volumetric type and in part the peristaltic type, squeezing a deformable conduit in addition to the centrifugal operation provided by the rotation of the impeller 5.

This operating mode not only has the effect of contributing to the generation of flow rate of the centrifugal pump 1, but also has the effect of regulating and stabilizing the flow rate of the pump itself, giving the fluid part of the energy necessary for the pumping thereof when the available centrifugal energy is not sufficient.

For example, the intervane channel that is defined between contiguous deformable vanes at the delivery 9 has a smaller volume with respect to the volume of the intervane channel that is defined between contiguous deformable vanes at the suction 7.

More in particular, following the rotation direction of the impeller 5, the volume of the intervane channel reaches a maximum at the separation zone 110 between the suction 7 and the delivery 9, then reducing gradually until finding a minimum at the separation zone 112 between the delivery 9 and the suction 7.

Given the eccentricity of the impeller 5 with respect to the external stator 30 the volume variation of the intervane channels between suction 7 and delivery is preferably gradual, and takes place during the suction phase (increasing) and delivery phase (decreasing).

Advantageously, in every position of the impeller 5 with respect to the stator 3 at least two deformable vanes 52 of the plurality of deformable vanes 50, 51, 52 are sealed in the portion 112 of the annular cavity 11 between the delivery 9 and the suction 7 to isolate the suction 7 from the delivery 9.

As illustrated in FIG. 1, in the position of the impeller 5 with respect to the stator 3 represented in the figure, in the portion 110 of the annular cavity 11 between the suction 7 and the delivery 9 four sealed deformable vanes 51 are provided and in the portion 112 of the annular cavity 11 between the delivery 9 and the suction 7 another four sealed deformable vanes 52 are provided.

Preferably, at least three sealed deformable vanes 51 are provided, in every position of the impeller 5 with respect to the stator 3, in the zone 110, between the suction 7 and the delivery 9.

Preferably, at least three sealed deformable vanes 52 are provided, in every position of the impeller 5 with respect to the stator 3, also in the zone 112, between the delivery 9 and the suction 7.

Preferably, there are at least five sealed deformable vanes 51, 52 in the zone 110 and/or in the zone 112.

The fact that a certain number "n" of sealed deformable vanes 51 are always present simultaneously allows the pressure difference between the suction 7 and the delivery 9 to be split. In substance, the pressure variation $\Delta P$ between the suction 7 and the delivery 9 is split into as many partial pressure changes as the number of sealed deformable vanes. In this way, each sealed deformable vane is strained by a pressure delta equal to $\Delta P/n$.

This allows the load on each sealed end of the deformable vanes to be reduced and all the volumetric losses to be reduced "n" times the losses in laminar flow, significantly increasing the efficiency. This is not possible for example in volumetric pumps with sliding vanes as, given the very high elastic modulus of fluids, even very small volume variations would cause an unacceptable bending load on the rigid vanes, making it compulsory, at least for a part of the rotation, to have only one sealed vane.

Advantageously, the deformable vanes 50, 51, 52 comprise a distal portion 53 having, at least in one part thereof, a radius of curvature RD at least 90% of the radius of curvature RS of the internal surface of the stator 3, in the portion thereof with a circular profile.

Advantageously, the deformable vanes 50, 51, 52 comprise a distal portion 53 having, at least in one part thereof, a radius of curvature RD substantial equal to the radius of curvature RS of the internal surface of the stator 3, in the portion thereof with a circular profile.

The fact that, at least in one part of the distal portion 53 of the deformable vanes 50, 51, 52, the radius of curvature RD is slightly less, or substantially equal, to the radius of curvature RS of the internal surface of the stator 3 along which such distal portion 53 of the vanes runs, allows substantial hydrodynamic sustenance to be generated, thus drastically reducing wear and friction.

Advantageously, the deformable vanes 50, 51, 52 comprise a rigid support 54 for connection to the central body 6 of the impeller 5. Such rigid support 54 is arranged, with respect to the impeller 5, along a direction such as to approximate the direction of the velocity vector w1 obtained from the combination of the input radial velocity v1 and the tangential velocity u1, as represented in FIG. 4.

In this way it is possible to make sure that the fluid, in any operating condition, entering from the suction 7 arranged in the central zone of the centrifugal pump 1 has a prevalently radial input velocity v1 with respect to a fixed reference system integral with the pump body, with zero on the line of the axis of rotation, and a resulting velocity w1 tangent to the proximal portion of the deformable vanes 50, 51, 52, in a rotating reference system with zero on the line of the axis of rotation and integral with the impeller 5 and with the deformable vanes 50, 51, 52 which define the conduits.

This work condition is also generally desirable in traditional centrifugal pumps, but in the latter it can only be effectively obtained in a narrow window of operating conditions of the pump, unlike what happens in the case of the pump according to the present invention.

Advantageously, the rigid supports 54 are sufficiently rigid so as not to substantially alter the conformation of the deformable vanes 50, 51, 52 when loaded.

Advantageously the deformable vanes 50, 51, 52 present a proximal portion 55 arranged on average along a direction D comprised between an average angle $\gamma$ of 40° and 80° with respect to a radial direction R of the impeller 5, as illustrated in FIG. 5.

Advantageously, the proximal portion 55 is defined by an arc of a circle, i.e. it has a substantially constant radius.

Advantageously, the deformable vanes 50, 51, 52 are made of a metallic material, preferably harmonic steel or highly resistant copper alloys for springs, or a carbon fibre based material.

As illustrated in FIG. 7, the deformable vanes 50, 51, 52 have, in an improved version of the invention, a configuration similar to that of leaf springs.

In particular, the deformable vanes 50, 51, 52 can comprise a main plate 500, associated, for example through a jointing element 501, with a secondary plate 502 arranged in the maximum bending moment zone of the vane itself.

The deformable vanes 50, 51, 52 can also comprise a number of plates higher than two.

Advantageously, the deformable vanes 50, 51, 52 have a transverse thickness comprised in the range between 1/150 and 1/40 of the length of the proximal portion 55, preferably comprised in the range between 1/130 and 1/50, more preferably comprised in the range between 1/120 and 1/60, even more preferably comprised in the range between 1/110 and 1/70.

The deformable vanes 50, 51, 52 have a curved profile, such as to generate between them conduits with a constant or slightly increasing section in the radial direction, from the centre towards the periphery of the impeller 5, until, in the end portion, near to the outer diameter, the conduit becomes convergent.

The deformable vanes 50, 51, 52 have a curved proximal portion 55, a curved distal portion 53 and a connecting intermediate portion 56 between said curved proximal portion 55 and said curved distal portion 53. Preferably, the radius of curvature of the proximal portion 55 is substantially greater than the radius of curvature of the distal portion 53, whereas the radius of curvature of the intermediate portion 56 is substantially lower than the radius of curvature of the distal portion 53.

Advantageously, as illustrated in FIG. 5, the intermediate portion 56 can be realized with a variable radius of curvature.

In this way, a hydrodynamic sustenance effect of the distal portion 53 and a correct inclination of the proximal portion 55 are obtained for defining a conduit between two appropriately inclined contiguous vanes and a connecting portion between the aforesaid two proximal 55 and distal 53 portions with a very limited extension or, as can be seen in FIG. 5, with a variable curvature.

The flow rate of the pump, neglecting volumetric losses which are however a lot smaller than those that occur in traditional volumetric pumps, is substantially constant as the pressure difference varies, such flow rate being driven by the eccentricity of the impeller 5.

The flow rate value can be approximated very well to that which can be calculated for a vane pump with an equivalent diameter, height and eccentricity. Therefore, the law of the flow rate as the pressure and velocity varies is very similar to that of a volumetric pump, whereas the energy conferred to the fluid largely derives from the centrifugal effect.

Also the flow of the fluid through the pump results continuous, just as the exchange of energy between the pump and the fluid takes place with continuity, because in any configuration of the vanes the fluid proceeds from the centre towards the periphery therefore it acquires energy, given that the peripheral velocity u increases, which can be expressed by u=w*r (w being the angular velocity and r the radius at which the quantity of fluid being examined is found).

This aspect provides the following very favourable technical effects:

1—the simple regulation of the impeller 5 velocity regulates the flow rate with good precision, regardless of the required head and neglecting moderate volumetric losses;

2—the flow rate-head curve is much more rigid than what happens in a traditional centrifugal pump, making the flow rate much less sensitive to pressure changes;

3—as a consequence of points 1 and 2, the velocity triangles remain similar to each other, because as the peripheral velocity increases, the flow rate increases in the same proportion and therefore the velocity of the fluid at the output and inside the conduit between the vanes, i.e. the flow rate is connected with the velocity by a substantially linear law. This implies that the pump always operates in the same maximum efficiency conditions, i.e. with the velocity triangles that have the same angles as the design value. On the contrary, in traditional centrifugal pumps, this only happens for a determined head of the centrifugal pump, which determines a certain flow rate, which is not in general the one in use.

In this way, the invention minimises so-called "due to impact" losses that usually occur in traditional centrifugal pumps.

The effect described above on velocity triangles derives not only from the flow rate which increases linearly with the rotation speed as described above, but also from the precise definition of the direction of the outflow velocity from the conduit between contiguous vanes.

This effect is due to the presence of the deformable vanes which are more numerous than those of a traditional pump due to their reduced size, mainly due to their reduced thickness.

Furthermore, the shape of the deformable vanes, provided with the end part that can be defined as being "skid shaped" since slidable along the external stator 30, determines the outlet of fluid that adheres greatly to the back of the contiguous vane. Again, the final converging portion (still due to the presence of the "skid") determines a jet that is well defined in shape and direction.

Figure 3:
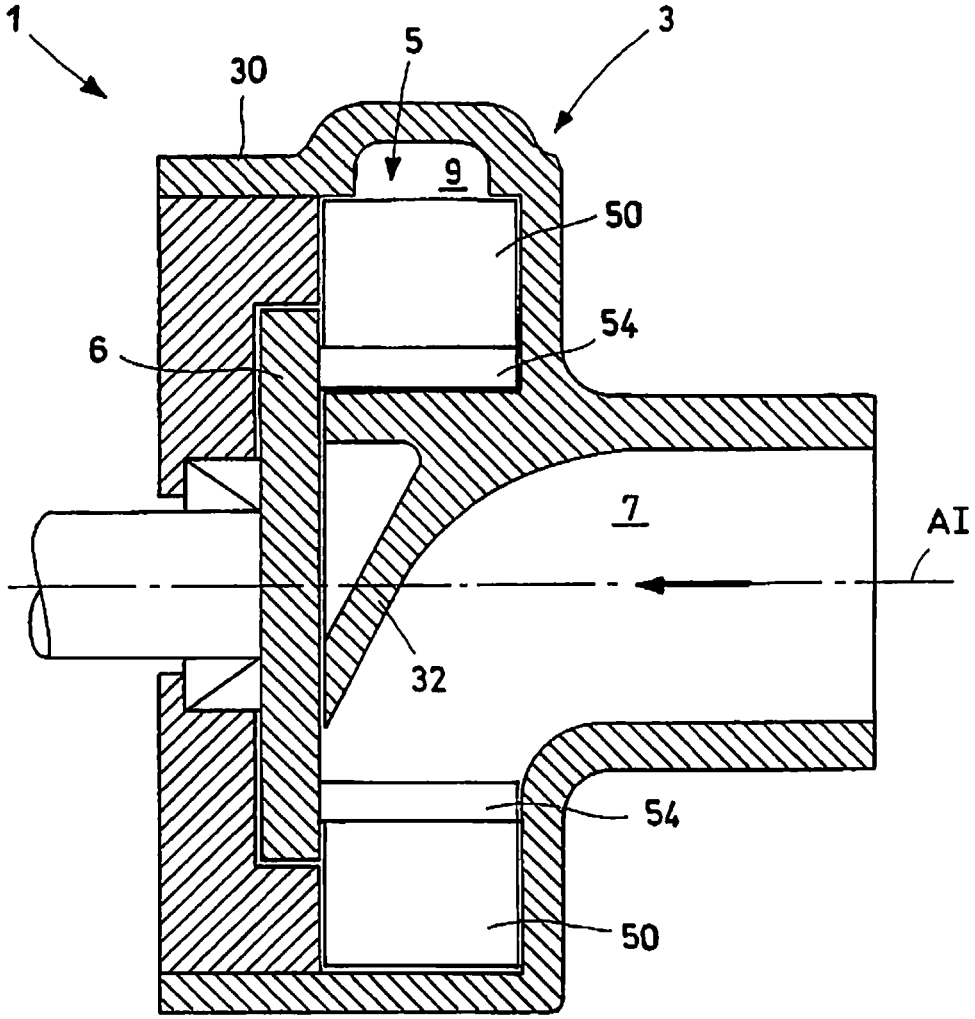
FIG. 3 is a sectional view of the pump represented in FIG. 1, performed according to the axis III-III.

Advantageously, as illustrated for example in FIG. 3, the inlet of the fluid into the intervane channels takes place in a substantially radial direction, with reference to an absolute reference system, relative to the stator, starting from a substantially central zone, close to the axis of rotation AI of the impeller 5.

Advantageously, each deformable vane 50, 51, 52 comprises a main plate 600 associated with a secondary plate 602, where such secondary plate 602 is configured to stiffen said main plate 600 at the portion or portions of the main plate 600 itself resting in an uninterrupted way on the stator 3.

With particular reference to FIG. 3, it is noted in fact that at the delivery 9, the main plate 600 has a rest on the stator 3 that is interrupted in the central zone and not interrupted in the side zones. The zone of the main plate 600 which rests on the stator 3 can vary, for example, based on the configuration of the delivery 9.

In any case, the secondary plate 602 insists on the part of the main plate 600 resting in an uninterrupted way on the stator 3. This allows the mechanical tensions that are formed in the deformable vane 50, 51, 52 to be distributed preventing any "bulging" in the radial direction in the zone where the deformable vane 50 is not resting on the stator 3.

Advantageously, each deformable vane 50, 51, 52 comprises, at the most internal radial end, a rigid support body 604 which has a jointing element 606 configured to be jointed into the central body 6 of the impeller 5.

Advantageously, as illustrated in particular in FIG. 8, the secondary plate 602 has a V-shaped or dovetail configuration.

As it can be seen in FIG. 3, in the passage at the delivery 9, the deformable vane 50 is only partially supported in the "skid" zone, whereas in other portions of the stator 3 the deformable vane 50 is completely supported by the stator 3 in the "skid" zone.

The presence of the secondary plate 602, useful for appropriately graduating the flexibility of the deformable vane 50 overall, is preferably V-shaped or dovetail shaped, and therefore prevents undesired deformations of the main plate 600, in particular at the delivery 9 where the contact of the deformable vane with the stator 3 is incomplete.

It has in practice been noted how the improved pump, according to the present invention, achieves the intended task and aims as it allows the efficiency and durability of pumps of the known type to be improved, also providing the possibility to operate in wide operating regimes, according to the user's requirements, without having the need for complex regulation typical of pumps with a variable geometry and without having the construction delicacy of pumps with a variable geometry with articulated mobile components.

In fact, for the low rotation speeds of the impeller, the pumping action due to the volume variation of the spaces comprised between consecutive vanes, according to the invention, will contribute to the centrifugal type operation, whereas at high rotation speeds of the impeller, the transfer of energy to the fluid will be almost exclusively of the centrifugal type and will be regulated by the volume variation of the spaces comprised between contiguous vanes.

Another advantage of the improved pump, according to the invention, consists of the fact that the geometric variation of the conduit defined between two contiguous deformable vanes due to the inflexion thereof generated by the moderate eccentricity generates a sort of squeezing of the conduit, almost a peristaltic motion, which protects against so-called vane detachments. Furthermore, the conduit maintains a substantially constant or slightly increasing section in proximity to the suction and is instead gradually reduced in section towards the delivery.

For the two aforesaid reasons, one of the dissipation factors of traditional centrifugal pumps is prevented: turbulence due to vane detachments as the conduit expands between contiguous vanes.

Another of the reasons for losses in traditional centrifugal pumps is the conversion of kinetic energy to head that takes place in the diffuser at the outlet of the conduit between contiguous vanes. Given that these losses are proportional to the absolute output velocity v2 of the impeller, in traditional pumps it is common practice to avoid the configuration of convex vanes in the rotation direction which, although increasing the possible head, generate higher speeds and greater losses, just as it is sought to reduce the output velocity v2 with diverging conduits between contiguous vanes that reduce the relative velocity w2, although on the contrary this promotes vane detachment.

This invention provides a very different and innovative strategy, represented in FIG. 6, compared with FIG. 4.

The output velocity w2 of the conduit between contiguous vanes is not reduced, but the concave orientation, backwards, of the vanes, is very accentuated and this is made possible by the conformation of the vanes with a skid which directs the flow backwards, keeping it adherent to the back of the contiguous vane.

In this way the vector sum between w2 and u2 (i.e., w2+u2=v2) leads v2 to be reduced in modulus as the tangential components of u2 and w2 are opposite and the angle $\alpha 2$ is very small because of the size of the angle $\beta 2^*$ and the proportion of w2.

Given that the output head (for v1 radial) can be approximated with the formula $$H=u2*v2*\cos(\alpha 2)$$

reducing the v2 modulus implies a reduction in the maximum possible head but a greater efficiency because a lower velocity value has to be transformed into head in a diffuser, a transformation that always implies significant losses. The pump must be appropriately sized so as to have an appropriately small w2 modulus.

The improved pump as conceived herein is susceptible to many modifications and variations, all falling within the scope of the invented concept; furthermore, all the details are replaceable by technically equivalent elements. In practice, the materials used, as well as the dimensions, can be of any type according to the technical requirements.

In practice, any materials can be used according to requirements, as long as they are compatible with the specific use, the dimensions and the contingent shapes.

The invention claimed is:

1. An improved pump comprising a stator comprising an external stator and an internal stator, and an impeller rotatably housed between said external stator and said internal stator, a suction being fashioned at a central portion of said internal stator, a delivery being fashioned at a radially external peripheral portion of said external stator, said impeller comprising a plurality of deformable vanes movable inside an annular cavity defined between said external stator and said internal stator and in slidable contact with an internal surface of said external stator, in every position of said impeller with respect to said stator at least two deformable vanes of said plurality of deformable vanes being sealed in a first portion of said annular cavity between said suction and said delivery to isolate said delivery from said suction, said impeller being rotatable about a central internal axis (AI) offset with respect to a central external axis (AE) of said external stator, a rotational eccentricity of said impeller with respect to said external stator determining a deformation of said deformable vanes, said deformation of said deformable vanes determining, at said delivery a reduction of the volume of space comprised between two contiguous deformable vanes that contributes to generation of flow rate of said improved pump, wherein said rotational eccentricity of said impeller is equal to a value between 1/40 and 1/22 of an internal diameter of said external stator.

2. The improved pump, according to claim 1, wherein in every position of said impeller with respect to said stator at least two deformable vanes of said plurality of deformable vanes are sealed in a second portion of said annular cavity between said delivery and said suction to isolate said suction from said delivery.

3. The improved pump, according to claim 1, wherein said deformable vanes comprise a distal portion having a radius of curvature (RD) equal to at least 90% of a radius of curvature (RS) of said internal surface of said external stator.

4. The improved pump, according to claim 1, wherein said deformable vanes comprise a distal portion having a radius of curvature (RD) substantially equal to a radius of curvature (RS) of said internal surface of said external stator.

5. The improved pump, according to claim 1, wherein said deformable vanes comprise a rigid support for connection to a central body of said impeller.

6. The improved pump, according to claim 1, wherein said deformable vanes have a proximal portion arranged along a direction that is on average between 40° and 80° with respect to a radial direction of said impeller.

7. The improved pump, according to claim 1, wherein said deformable vanes are made of a metal material or of a carbon fibre based material.

8. The improved pump, according to claim 1, wherein said deformable vanes have a transverse thickness between 1/150 and 1/40 of the length of a proximal portion of said deformable vanes.

9. The improved pump, according to claim 1, wherein said deformable vanes have a curved proximal portion, a curved distal portion and an intermediate portion connecting said curved proximal portion and said curved distal portion, a radius of curvature of said proximal portion being substantially greater than a radius of curvature of said distal portion, a radius of curvature of said intermediate portion being substantially lower than the radius of curvature of said distal portion.

10. The improved pump, according to claim 1, wherein said deformable vanes have a curved proximal portion, a curved distal portion and an intermediate portion connecting said curved proximal portion and said curved distal portion, said proximal portion having a constant radius of curvature, a radius of curvature of said intermediate portion being variable for connecting said proximal portion and said distal portion.

11. The improved pump, according to claim 1, wherein said deformable vanes have a leaf spring configuration.

12. The improved pump, according to claim 1, wherein said deformable vanes comprise a main plate associated with at least a secondary plate arranged in an area of maximum bending moment of said deformable vanes.

13. The improved pump, according to claim 1, wherein an inlet of fluid into a space comprised between two contiguous deformable vanes takes place in a substantially radial direction starting from a substantially central zone in proximity to said internal central axis (AI) of said impeller.

14. The improved pump, according to claim 1, wherein each deformable vane comprises a main plate associated to a secondary plate, said secondary plate being configured to stiffen said main plate at a portion or portions of said main plate resting in an uninterrupted way on said stator.

15. The improved pump, according to claim 14, wherein said portions of said main plate resting in an uninterrupted way on said stator are side portions of said main plate.

16. The improved pump, according to claim 14, wherein said secondary plate has a V-shaped or dovetail configuration.

* * * * *